US005662330A

United States Patent [19]

Spears

[11] Patent Number: 5,662,330

[45] Date of Patent: Sep. 2, 1997

[54] HIGH LOW DICE GAMBLING SYSTEM AND METHOD THEREFOR

[76] Inventor: Richard L. Spears, 5118 N. Estrella Rd., Golden Valley, Ariz. 86413

[21] Appl. No.: 755,680

[22] Filed: Nov. 25, 1996

[51] Int. Cl.[6] ..... A63F 9/04

[52] U.S. Cl. ..... 273/274; 273/309

[58] Field of Search ..... 273/274, 146, 273/309

[56] References Cited

U.S. PATENT DOCUMENTS 5,265,881 11/1993 Doherty ..... 273/274
5,308,081 5/1994 Bartle ..... 273/274
5,350,175 9/1994 DiLullo et al. ..... 273/146

FOREIGN PATENT DOCUMENTS 2252918 8/1992 United Kingdom ..... 273/146

*Primary Examiner*—Benjamin H. Layno
*Attorney, Agent, or Firm*—Harry M. Weiss; Jeffrey D. Moy; Harry M. Weiss & Associates, P.C.

[57] ABSTRACT

A gaming system and method comprising a flat craps table constructed and adapted for a set of five dice to be rolled thereupon, a set of five dice, and betting indicia on the table defining betting spaces, the betting spaces respectively being identifiable as winning spaces if, respectively, the dice, when rolled and the number of spots thereon counted and totaled, define specific totals or sets of numbers is disclosed.

13 Claims, 3 Drawing Sheets

HIGH LOW DICE GAMBLING SYSTEM AND METHOD THEREFOR

FIELD OF THE INVENTION

This invention relates generally to gambling devices and systems and, more particularly, to a dice gaming system and method based on the use of five dice.

BACKGROUND OF THE INVENTION

Craps is a traditional dice game played completely against the casino. Up to 24 people can play a traditional craps game at once, depending on the size of the table. Each dealer handles half the table, with people standing around the table. The stickman controls the bets made in the center of the table, and also uses a long stick to push the dice toward the shooter and to pull them in after each roll is made. The stickman also announces the number rolled. The boxman is the money-keeper and the "boss" of the table; he doles money out to the dealers so they can pay winnings, collects cash that people exchange for chips, and handles disputes between dealers and players. Dice pass to the right, clockwise, and change hands when a player sevens-out by control of the stickman.

Craps has the best odds for the player out of all the regular casino games. By comparison, in card games, the players have a chance of getting one of 52 cards on the first deal. Once the player pick the first cards, there are 51 other possibilities for the second card, 50 for the third and so on. By the time the player gets to the fifth card, the player has received one of 311,875,200 different combinations, most of which are losers in a card game. In craps, there are, for each dice, only 36 possible combinations. The combinations are 1,1; 1,2; 1,3; 1,4; . . . 6,1; 6,2; 6,3; 6,4; 6,5; and 6,6. Since there are fewer possibilities, the odds are lower and the chances of winning are higher. Each spot on the six-sided dice used in the game is worth one point. If the player rolls a seven or 11 on the first roll, the player wins automatically. If the player repeatedly rolls "7"s, the player will double his or her money each time, until a point is established. Out of all the combinations that could be rolled, there are only two that add up to 11 points, a five first and a six second, or a six first and a five second. Statistically, that is one-eighteenth of the possibilities. However, there are several combinations for seven. They are 6,1; 1,6; 5,2; 2,5; 4,3; and 3,4. That represents one-sixth of the possibilities. Combined, the player has approximately an 18 percent chance of winning on the first roll. If the player rolls a 2, 3 or 12 on the first try, he/she automatically loses. There is only one combination for 2—1,1— and only one for 12— 6,6. A three shows up with 1,2 and 2,1. Mathematically speaking, there is approximately a 12 percent chance of losing on the first roll. If any other point total shows up besides 1, 2, 7, 11 and 12, the player must roll the dice again and keep rolling them until he/she matches that point total or "craps out" by rolling a seven. But the player does not have to be rolling the dice to take part in the game. All around the table are lines and areas that show the odds being paid on several different things relating to the rolls, and where others can place bets.

The traditional craps table will hold between 12–24 players. The most common bet in craps is to put some money in front of the "pass line." The player may, for example, put $2 down and if a "7" or "11" comes up, the player has just doubled his or her money. The dealer will place his or her winnings on the side of his or her original bet and if the player does not pick it up before the next throw, it will become another bet. If a 4,5,6,8,9,10 is rolled, that number becomes the point number. The dealer will put the black marker on the appropriate number so the player will not forget what point number his or her pass line bet represents.

If that point number comes up, the player wins even money. If a "7" comes up the player loses. The 2,3 or 12 only effects the roll before the point is made.

A player may also take "odds." As the player places odds, his or her advantage increases. The player makes this bet by putting his or her chips behind the pass line. The player may take "odds on his or her bet." For example, if the point came up "6" and the player had a $10 pass line bet, a 6 or 8 can be rolled five ways, the "odds" against a "6" is 6-5. The odds for the "4" or "10" is 2-1, "5" or "9" is 3-2 and the "6" or "8" is 6-5. These are the true odds. If the player wins his or her bet off the "pass line," the player will be paid even money. If the player had $10 "odds," that would pay the player an additional $12 because odds are paid at 6-5 in the case of the "6."

Every player has the right to shoot the dice when it is their turn. The shoot goes around the table in a clockwise fashion. When it is his or her turn, the player makes his or her line bet and selects two dice. The dice are thrown hard enough to reach the end of the table and hopefully bounce off the side. The player will continue to shoot until the player craps-out. The longer the shoot, the more money everyone makes.

There are, of course, variations on the traditional game of craps. For example, while craps is usually played with two dice, a three-dice variation and a special table has been described by Franklin in U.S. Pat. No. 5,413,351. Vancura, U.S. Pat. No. 5,513,85 describes a craps-type game in which four dice are rolled in some instances.

The present invention is based in part on the general rules for craps as outlined above; however, there are important advances and advantages in the dice game, table and system, described and claimed herein.

SUMMARY OF THE INVENTION

This invention relates to a new, different, fast and fun dice game. The game involves five dice and is called "High Low Craps." It is very easy to play and can be played on different layouts. The game meets all requirements of the gaming commission and gives the gamblers a fair chance to win while the casino makes its money. It can be played preferably in either 15-player or 7 player layouts, although other configurations are possible without departing from the spirit or scope of the invention.

The dealer and two stick-men control the game when using a 15-player layout. The game starts when the player lays the wager on High or Low for even money and/or the player can go for odds at the same time. The odds consist of 17 or 18, any straight or any five of a kind, or a high or low five of a kind.

When all wagers have been made, the dealer then turns a shaker containing five dice and then calls out the winning bets based on what the dice add up to. If the dice add up to any number less than 17, the dealer calls out "Low wins." If the dice add up to any number more than 18, the dealer calls out "High wins." If the dice add up to 17 or 18, then the players betting on either number win and get the odds. A total of 17 or 18 is not considered high or low, and, thus, they pay out odds. If the dice form a straight of from 1 to 5, the dealer will call out "any straight" and Low bets win. If the dice form a straight from 2 to 6, the dealer will call out "any straight" and High wins. If the dice form five of a kind of ones, twos or threes, the dealer will call out "any five of a kind," and five of a kind and Low are the winning bets. If the five of a kind are fours, fives or sixes, the dealer will call "out any five of a kind," in which case, five of a kind and High are the winning bets.

Other persons standing behind the seated players can also place wagers, thereby making it possible for others to win or lose as the case may be.

The invention also comprises a smaller, seven player layout which requires only one dealer and may be used primarily in early hours or on slow days. The seven player layout uses the same rules and has the same odds.

One of the features of the present invention is that it uses five dice and winning combinations are formed using sets usually associated with poker, i.e., straights and five of a kind.

Special games other than the game as described in detail herein can be played for Casino slot clubs or special times or days.

DESCRIPTION OF THE PREFERRED EMBODIMENTS

The invention is illustrated and described in reference to the figures and to exemplary embodiments. The invention is not limited to the specific embodiments described and illustrated, however. Virtually any structure that permits the play of the game as described may be used, for example, and the shape of the table may vary. More or less than the indicated play stations may be used. The invention may also be embodied in board game or computerized form. Other variations are contemplated within the scope of the invention.

Figure 1:
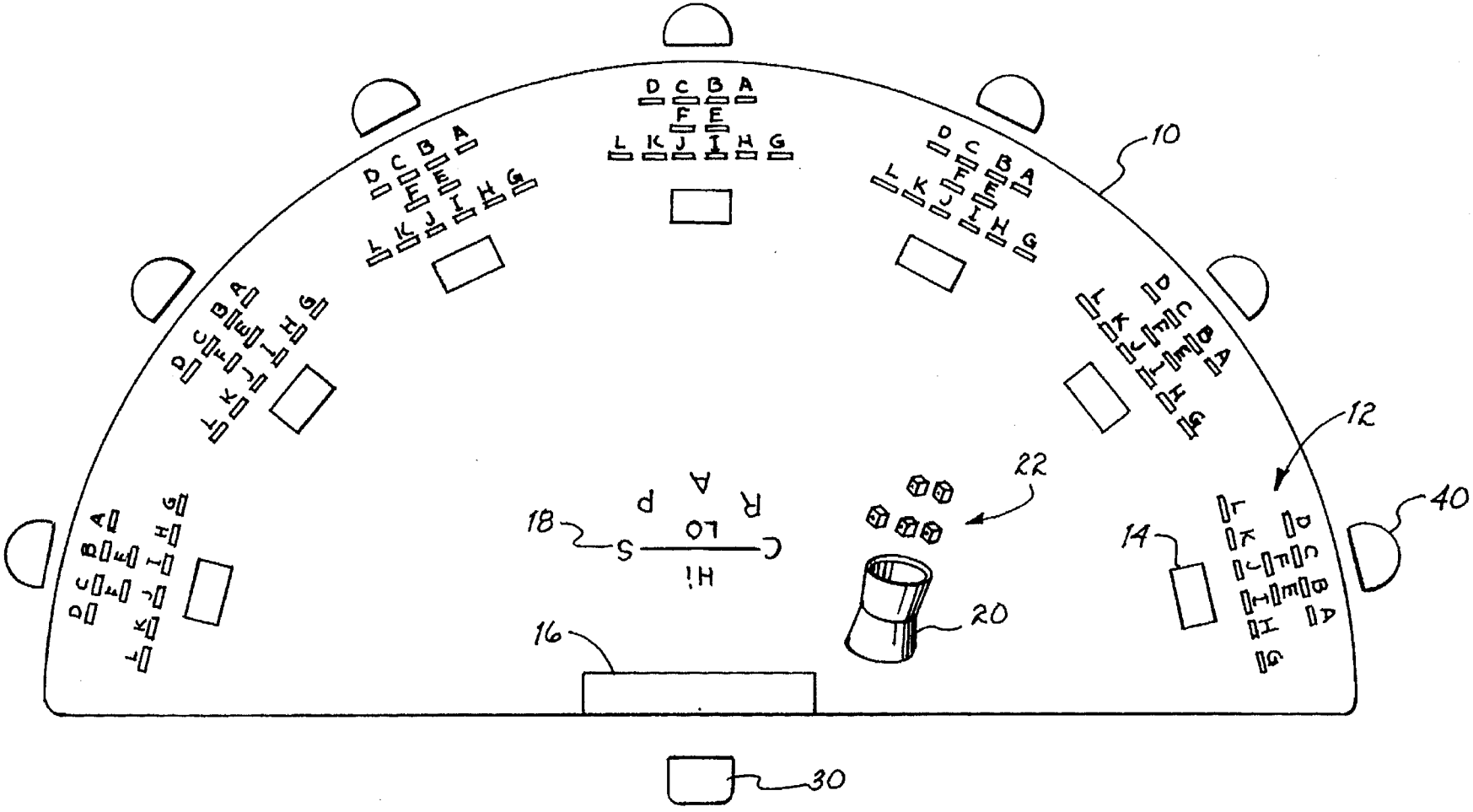
FIG. 1 depicts in generally schematic fashion the playing surface of a special craps-type table embodying the present invention in one form designed for use by up to seven players.

Referring first to FIG. 1, the playing surface of a special craps table is depicted for use with one dealer and, in the example, up to seven players. A table with seven player stations is convenient, but six or eight, or more or less, player stations could as easily be provided.

The table surface 10 is flat and, in this embodiment, generally in the form of a half-circle, though the precise shape is not critical. As with traditional craps tables, the surface would be suitably covered, typically with a thin green felt fabric glued to a hard flat surface.

Printed, silk screened or otherwise formed on the surface are a plurality of sets of indicia 12 each of which defines a player station. Each of the indicia sets 12 comprise markings that define betting spaces upon which the player places his betting chips. The betting spaces may be labeled in any way that provides information to the player regarding the bet placed thereon. In the exemplary embodiment, the betting spaces in each of the player stations are marked, respectively, "A" through "L," which markings have the following assigned meanings:

A="LOW," which pays even money.

B="17," which pays the lowest odds.

C="18," which pays the lowest odds.

D="HIGH," which pays even money.

E="Any 5 of a kind," which pays second lowest odds.

F="Any straight," which pays third lowest odds.

G through L=Respectively, "Five ones," "Five twos," "Five threes," "Five fours," "Five fives," and "Five sixes," which pay the highest odds.

The specific odds, which control the amount paid on a winning roll of the dice, are calculated using well-established mathematical probability theory and are established by the casino management. For example, the odds of rolling five of a kind is one in 7,776, and the casino pay-off for such a roll would be based on that figure, as adjusted by such margins as the casino may establish.

The table may include indicia 16 marking the dealer's station and bank and may also include a trademark logo or other identifying or information providing indicia 18.

The gaming system of this invention also includes, in addition to the table as described, a set of five dice 22 and a dice shaker 20.

While not part of the gaming system of the invention, chairs or stools 30 for the dealer and/or the players, indicated at 40, may also be provided.

Figure 2:
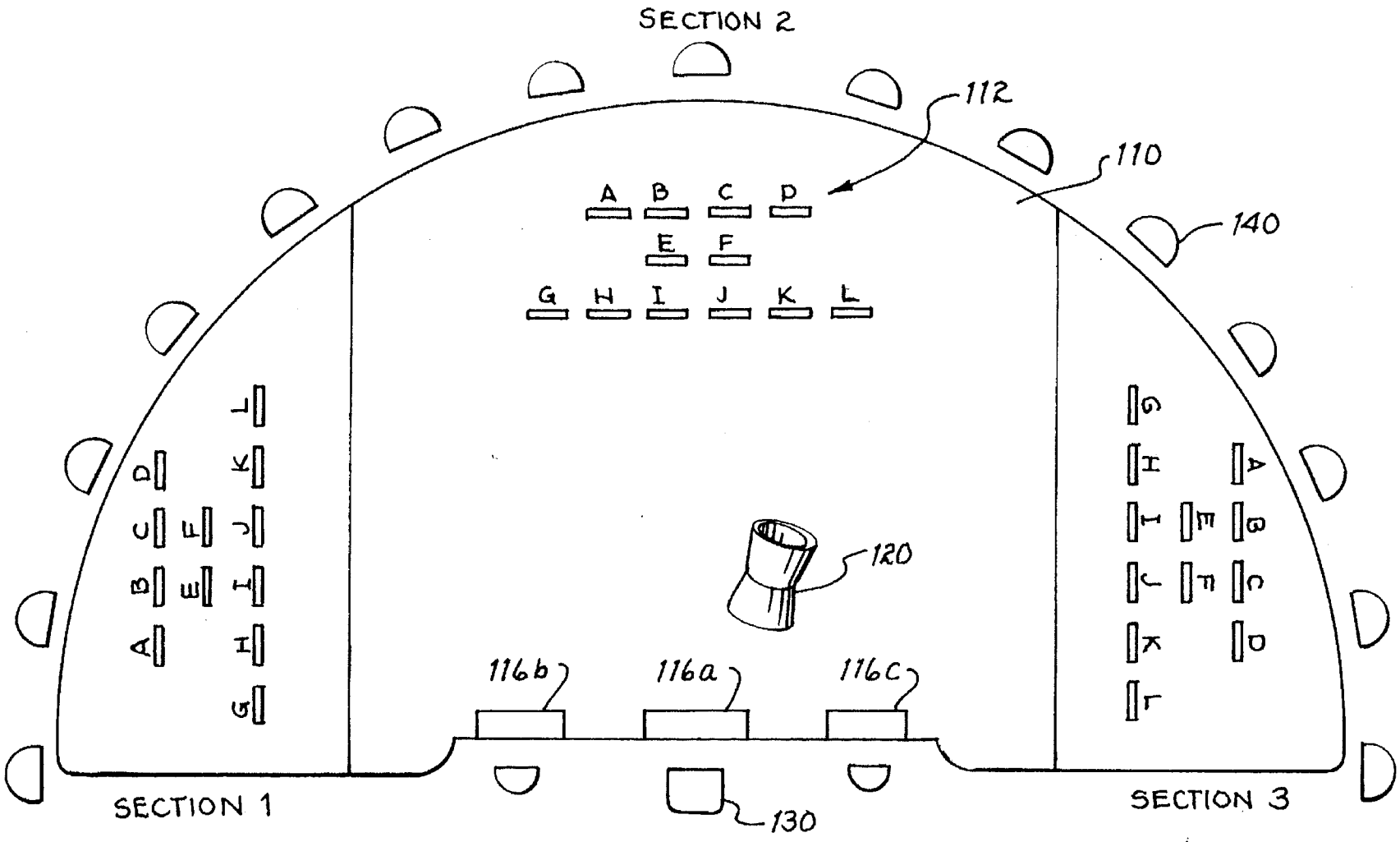
FIG. 2 depicts in generally schematic fashion the playing surface of a special craps-type table embodying the present invention in a second form designed for use by up to fifteen players.

FIG. 2 depicts a table designed to accept up to 15 players and operated by a dealer or pit boss and two stickmen. The table 110 of this embodiment also contains a plurality of player stations 112 which contain the same betting spaces as described, except that each station serves five players and the betting spaces may be larger. The player stations are, in the preferred embodiment, arranged in three sections, as shown on the drawing, of five player stations each. The game is operated by a dealer or pit boss at station **116*a*, and two stickmen at stations 116*b* and 116*c*. A dice tumbler 120**, containing the five dice (not shown), is also provided as part of this gaming system.

Figure 3:
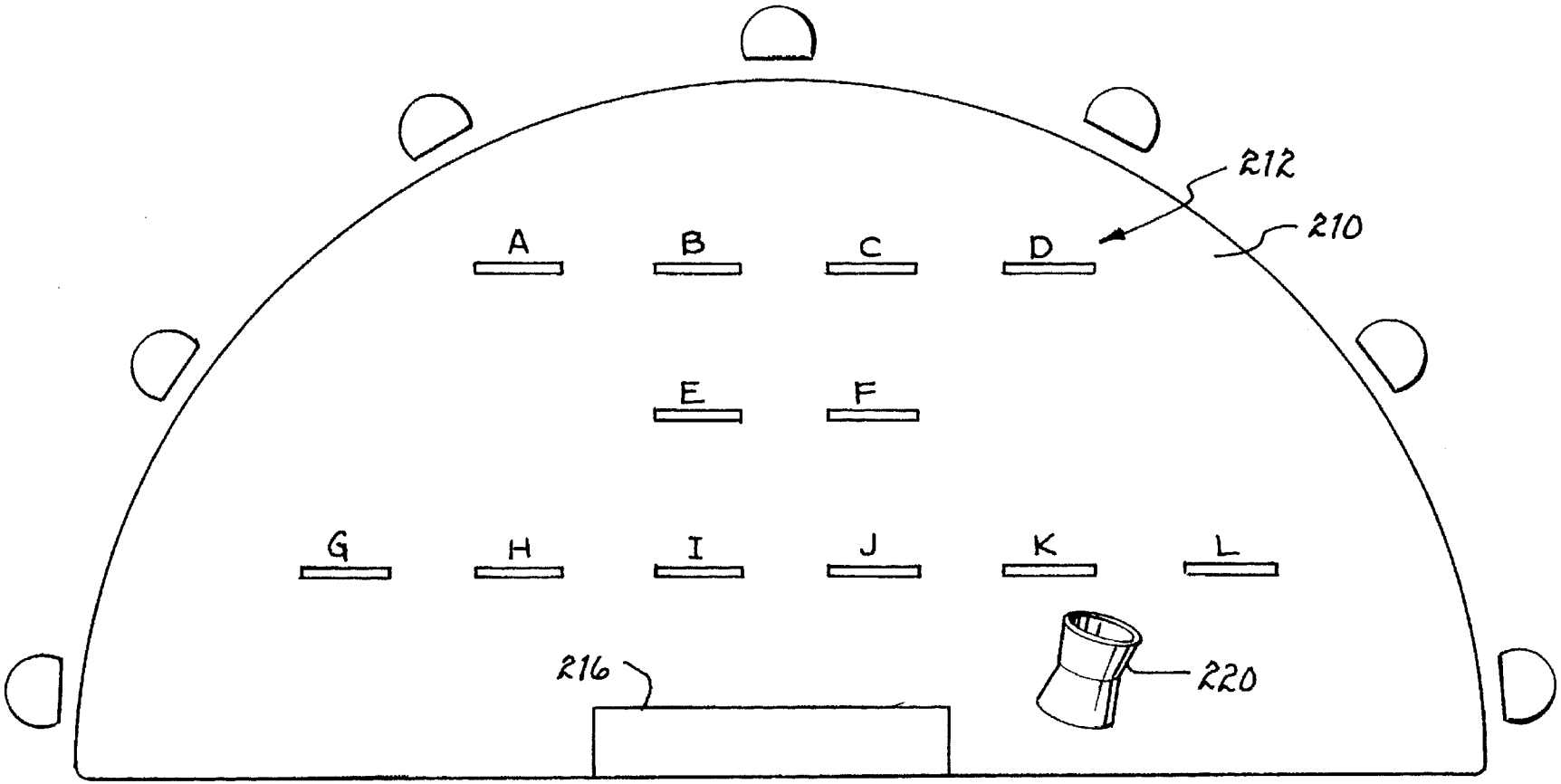
FIG. 3 depicts in generally schematic fashion the playing surface of a special craps-type table embodying the present invention in a third, simplified, form designed for use by up to seven players.

The gaming device of FIG. 3 is identical in concept, as to mode of play, to those described above, but is simplified so that one dealer can more easily control the table. The table 210 has only one set of indicia 212 used by all of the players at the table. The dealer station 216 is positioned to permit the dealer to reach all of the table using traditional craps sticks. Again, a tumbler 220 with five dice (not shown) is provided as part of the gaming system.

As indicated above, the gaming device of this invention is used to play-type game which generally follows craps rules and procedures. While no further explanation is necessary for those skilled in the art, a brief summary of the order of play is given by way of illustration.

The players take their respective stations. Each player places his or her bet or bets in the respective betting spaces, as described above. Typically, the dealer will "roll" the dice by inverting the shaker 20, 120, or 220; however, the dealer or a player may instead throw the dice against a wall on the table as in a traditional craps game. When the dice have been played, the dealer calls the winners, the winners are paid off at the odds for the particular bet or bets and the losers' money is pulled into the bank. The winning combinations are as set forth hereinbefore. The dealer then calls for the bets to be placed. When the bets have been placed, the play repeats as summarized above.

It will now be better understood that no specific shapes or structures, other than a craps type table, board game, or computer-type game with the indicia as described and dice or dice equivalents, are required to play the game of this invention, and that many variations will be within the scope of the invention.

Industrial Application

This invention is useful in the gaming and toy industries.

What is claimed is:

1. A gaming system comprising, in combination:

table means constructed and adapted for dice means to be used thereupon;

dice means for cumulatively and randomly generating five numbers between the numbers one and six; and betting spaces located on said table means and having betting indicia for permitting betting on different possible number combinations;

said betting spaces being substantially identifiable as winning spaces if said five numbers generated by said dice means define at least one of the following:
a sum of said five numbers is less than 17;
a sum of said five number is 17;
a sum of said five numbers is 18;
a sum of said five numbers is greater than 18;
said five numbers are identical;
said five numbers are in numerical order;
each of said five numbers is one;
each of said five numbers is two;
each of said five numbers is three;
each of said five numbers is four;
each of said five numbers is five; and
each of said five numbers is six.

2. A gaming system in accordance with claim 1 wherein said dice means comprise five individual dice cubes having numbers one through six thereon.

3. A gaming system in accordance with claim 1 wherein said betting spaces further display odds information in substantially the following manner:

payment of even money, having a sum of said five numbers less than 17;

payment of lowest odds, having a sum of said five numbers equal to 17;

payment of lowest odds, having a sum of said five numbers equal to 18;

payment of even money, having a sum of said five numbers greater than 18;

payment of odds that are greater than said lowest odds and less than said highest odds, having said five numbers identical;

payment of highest odds, having each of said five numbers equal to one;

payment of highest odds, having each of said five numbers equal to two;

payment of highest odds, having each of said five numbers equal to three;

payment of highest odds, having each of said five numbers equal to four;

payment of highest odds, having each of said five numbers equal to five;

payment of highest odds, having each of said five numbers equal to six;

payment of odds that are greater than said lowest odds and less than said highest odds, having each of said five numbers equal to one of a group including one, two, three, four, five, and six; and payment of odds that are greater than said lowest odds and less than said highest odds, having said five numbers in numerical order.

4. A gaming system in accordance with claim 1 wherein said table means having means for permitting more than one person to use said betting spaces.

5. A gaming system in accordance with claim 4 wherein said table means having means for permitting seven persons to use said betting spaces.

6. A gaming system in accordance with claim 4 wherein said table means having means for permitting fifteen persons to use said betting spaces.

7. A method for providing a gaming system comprising the steps of:

providing table means constructed and adapted for dice means to be used thereupon;

providing dice means for cumulatively and randomly generating five numbers between the numbers one and six; and providing betting spaces located on said table means and having betting indicia for permitting betting on different possible number combinations;

said betting spaces being substantially identifiable as winning spaces if said five numbers generated by said dice means define at least one of the following:
a sum of said five numbers is less than 17;
a sum of said five numbers is 18;
a sum of said five numbers is 18;
a sum of said five numbers are greater than 18;
said five numbers are identical;
said five numbers are in numerical order;
each of said five numbers is one;
each of said five numbers is two;
each of said five numbers is three;
each of said five numbers is four;
each of said five numbers is five; and
each of said five numbers is six.

8. The method of claim 7 wherein said dice means comprise five individual dice cubes.

9. The method of claim 7 wherein said dice means comprises a computer-type random number generator.

10. The method of claim 7 wherein said betting spaces further display odds information in substantially the following manner:

payment of even money, having a sum of said five numbers less than 17;

payment of lowest odds, having a sum of said five numbers equal to 17;

payment of lowest odds, having a sum of said five numbers equal to 18;

payment of even money, having a sum of said five numbers greater than 18;

payment of odds that are greater than said lowest odds and less than said highest odds, having said five numbers identical;

payment of highest odds, having each of said five numbers equal to one;

payment of highest odds, having each of said five numbers equal to two;

payment of highest odds, having each of said five numbers equal to three;

payment of highest odds, having each of said five numbers equal to four;

payment of highest odds, having each of said five numbers equal to five;

payment of highest odds, having each of said five numbers equal to six;

payment of odds that are greater than said lowest odds and less than said highest odds, having each of said five numbers equal to one of a group including one, two, three, four, five, and six; and payment of odds that are greater than said lowest odds and less than said highest odds, having said five numbers in numerical order.

11. The method of claim 9 wherein said step of providing table means further comprises the step of providing means for permitting more than one person to use said betting spaces.

12. The method of claim 11 wherein said table means having means for permitting seven persons to use said betting spaces.

13. The method of claim 11 wherein said table means having means for permitting fifteen persons to use said betting spaces.

* * * * *